US010780009B2

(12) United States Patent
Bucher et al.

(10) Patent No.: US 10,780,009 B2
(45) Date of Patent: Sep. 22, 2020

(54) APPARATUS FOR LOCOMOTION THERAPY

(71) Applicant: Hocoma AG, Volketswil (CH)

(72) Inventors: Rainer Bucher, Wettswil (CH); Konstantin Daremas, Elsau (CH)

(73) Assignee: HOCOMA AG, Volketswil (CH)

( * ) Notice: Subject to any disclaimer, the term of this patent is extended or adjusted under 35 U.S.C. 154(b) by 1155 days.

(21) Appl. No.: 14/442,016

(22) PCT Filed: Nov. 8, 2013

(86) PCT No.: PCT/EP2013/073372

§ 371 (c)(1),
(2) Date: May 11, 2015

(87) PCT Pub. No.: WO2014/076005

PCT Pub. Date: May 22, 2014

(65) Prior Publication Data

US 2015/0320630 A1 Nov. 12, 2015

(30) Foreign Application Priority Data

Nov. 13, 2012 (EP) ..... 12192459

(51) Int. Cl.
*A61H 1/02* (2006.01)
*A61H 39/04* (2006.01)

(52) U.S. Cl.
CPC ..... *A61H 1/02* (2013.01); *A61H 1/0229* (2013.01); *A61H 1/0262* (2013.01); *A61H 39/04* (2013.01);
(Continued)

(58) Field of Classification Search
CPC ..... A61H 1/00–005; A61H 1/02; A61H 1/0218–0229; A61H 1/0237–0244;
(Continued)

(56) References Cited

U.S. PATENT DOCUMENTS 2,695,017 A 11/1954 Herrmeyer
4,535,762 A 8/1985 Natchev
(Continued)

FOREIGN PATENT DOCUMENTS

CN 2199770 Y 6/1995
CN 101810532 A 8/2010
(Continued)

OTHER PUBLICATIONS

Chinese Office Action dated Aug. 17, 2017.
(Continued)

*Primary Examiner* — Rachel T Sippel
(74) *Attorney, Agent, or Firm* — Seyfarth Shaw LLP; Brian Michaelis

(57) ABSTRACT

Apparatus for locomotion therapy is provided which includes a base (11), a first table portion (15) and a tilting mechanism (12, 13) to tilt said first table portion (15) between a horizontal position, an inclined or a vertical position. A foot mechanism (16) is mounted to the first table portion (15). Furthermore, the position of a second table portion (17) is adjustable with respect to the first table portion (15) to adapt the apparatus to patients of different heights.

23 Claims, 14 Drawing Sheets

(52) U.S. Cl.
CPC ..... *A61H 2201/0192* (2013.01); *A61H 2201/1207* (2013.01); *A61H 2201/1238* (2013.01); *A61H 2201/1626* (2013.01); *A61H 2201/1638* (2013.01); *A61H 2201/1642* (2013.01); *A61H 2201/1652* (2013.01); *A61H 2201/501* (2013.01); *A61H 2201/5046* (2013.01); *A61H 2201/5061* (2013.01); *A61H 2201/5069* (2013.01); *A61H 2201/5097* (2013.01); *A61H 2203/0406* (2013.01); *A61H 2203/0456* (2013.01); *A61H 2205/125* (2013.01)

(58) Field of Classification Search
CPC . A61H 1/0255–0266; A61H 2001/0203–0211; A61H 2001/0248–0251; A61H 2201/0192; A61H 2201/0196; A61H 2201/1207; A61H 2201/123; A61H 2201/1238; A61H 2201/1626; A61H 2201/1628; A61H 2201/163; A61H 2201/1638; A61H 2201/164; A61H 2201/1642; A61H 2201/165; A61H 2201/1652; A61H 2201/501; A61H 2201/5046; A61H 2201/5061; A61H 2201/5069; A61H 2201/5097; A61H 2203/0406; A61H 2203/0456
See application file for complete search history.

(56) References Cited

U.S. PATENT DOCUMENTS

| | | | | |
|---|---|---|---|---|
| 4,662,681 | A | 5/1987 | Favaretto | |
| 5,267,924 | A | 12/1993 | Miller et al. | |
| 6,685,658 | B1 | 2/2004 | Dietz et al. | |
| 7,097,628 | B1 | 8/2006 | Baune | |
| 7,137,959 | B2 * | 11/2006 | Phillips | A61H 1/0237 601/5 |
| 2005/0227837 | A1 * | 10/2005 | Broadbent | A61H 1/0237 482/148 |
| 2005/0251067 | A1 * | 11/2005 | Terry | A61H 1/0214 601/5 |
| 2007/0043308 | A1 * | 2/2007 | Lee | A61H 1/0237 601/34 |

FOREIGN PATENT DOCUMENTS

| | | | |
|---|---|---|---|
| CN | 102028476 | A | 4/2011 |
| CN | 102512307 | A | 6/2012 |
| EP | 0205018 | A2 | 12/1986 |
| EP | 1169003 | B1 | 3/2004 |
| RU | 1669108 | A1 | 9/1996 |
| RU | 2010139613 | A | 3/2012 |

OTHER PUBLICATIONS

Search Report for PCT/EP2013/073372.
European Search Report, dated Nov. 7, 2016, Applicant: Hocoma AG, 5 pages.

* cited by examiner

APPARATUS FOR LOCOMOTION THERAPY

The present invention relates to an apparatus for locomotion therapy which enables to start locomotion training in an early stage of rehabilitation therapy.

In incompletely paraplegic patients the possibility has been shown to exist of improving walking ability up to normality by means of adequate locomotion training. To this end, an apparatus has been developed to provide an intensive walking training (activation of the central pattern generator in the spinal cord) of paraparetic and hemiparetic patients in early stages of rehabilitation when they are for example in a still unstable circulatory situation. Such an apparatus is for example described in EP 1 169 003 B1. In the apparatus described in this document, a table is provided which may be moved gradually between a horizontal position corresponding to a horizontal position of a patient to a vertical position corresponding to an upright position of the patient. Furthermore, in this apparatus a knee mechanism and a foot mechanism are provided, the knee mechanism being able to move the knees and therefore the legs of a person without the person himself having to exert any effort.

In this apparatus, the foot mechanism as well as the knee mechanism have an adjustable position on the table to be able to adjust the apparatus to various heights of patients. However, depending on the height of the patient such an adjustment may result in the patient being relatively high above the ground in a vertical position of the table, which for example may make it more difficult for a therapist to care for the person, which is in particular needed if the person is in an unstable circulatory condition or otherwise still seriously impaired.

Therefore, it is an object of the present invention to provide an apparatus for locomotion therapy of the general kind described in EP 1 169 003 B1 in which a position of a person in the vertical position of the apparatus may be kept low.

In this respect, an apparatus as defined in claim 1 is provided. The dependent claims define further embodiments, at least some of which define further improvements of the above-mentioned apparatus of EP 1 169 003 B1.

According to an embodiment, an apparatus for locomotion therapy is provided, comprising:

a base, a first table portion, a tilting mechanism coupling said base to said first table portion, a foot mechanism mounted to said first table portion, a leg movement mechanism for moving the legs, in particular the knees, of a patient, and a second table portion coupled to said first table portion, a position of said second table portion being adjustable with respect to said first table portion to adapt the apparatus to different heights of patients.

In such an apparatus, using the tilting mechanism a table formed by the first table portion and the second table portion may be moved between a horizontal position and a vertical position. As the foot mechanism is mounted to the first table portion, and the adjustment to a height of the patient is performed by adjusting the position of the second table portion which is coupled to the first table portion, the position of the foot mechanism in particular in a vertical position is independent of an adjustment of the apparatus to the size of the person, which may keep a position of the patient low and make it easier for therapists to care for the patients. In other words, the second table portion in such embodiments is connected to the tilting mechanism only via the first table portion, but not directly.

In an embodiment, the tilting mechanism may tilt the first table portion about an axis coupling the first table portion with the tilting mechanism. Furthermore, in an embodiment, the apparatus additionally comprises a lifting mechanism to move said first table portion, possibly together with said tilting mechanism, in a vertical direction.

In addition to the adjustment of the second table portion with respect to the first table portion for height adjustment, the second table portion may be tiltable with respect to the first table portion to selectively adjust a hip extension or hip flexion.

In some embodiments, the foot mechanism may comprise a first footrest and a second footrest. In an embodiment, the first and second footrests may comprise load sensors to measure a load the patient exerts on the footrest. Alternatively or additionally, other load sensing mechanisms may be provided to measure the load. In other embodiments, additionally or alternatively to the load sensors the first and second footrests may comprise mechanical stimulating elements for selective mechanical stimulation of areas of the feet of the patient. This mechanical stimulation may be performed synchronously with a movement of the leg movement mechanism.

The foot mechanism may further comprise a first base and a second base, the first and second bases being mounted to the first table portion, for example slidably mounted to the first table portion to accommodate movements of the legs. The first footrest may be mounted to the first base portion via a first double joint, and the second footrest may be mounted to the second base portion via a second double joint. Via such double joints, which may comprise a rod, a plate or other elongated element between the two joints, one end of the rod being coupled with the first footrest at a tip portion thereof via a first joint of the double joint and a second end of the rod being coupled with the base portion via a second joint of the double joint, a natural movement of the foot may be improved. In some embodiments, the natural movement may be additionally improved by generating an additional stimulus on the foot through an impact when the footrest is decelerated or stopped at a stopper. This stopping may be performed using a resilient stopper like a spring to adjust the force acting on the foot.

It should be noted that the above-described foot mechanisms may also be used in other apparatuses for locomotion therapy than the one described above.

The apparatus may further comprise an electrical stimulation device which may be configured to electrically stimulate muscles, in particular leg muscles, of the person synchronously with a movement of the leg movement mechanism.

The leg movement mechanism may comprise a first mechanism for a left leg and a second mechanism for a right leg of the patient. A distance between the first mechanism and the second mechanism may be adjustable to accommodate the leg movement mechanism to a "track width" of the patient. Such an adjustment may also be used independently of the apparatus described above, i.e. may also be used in other apparatuses for locomotion therapy.

In some embodiments, a pelvic harness may be fixed to said first table portion and/or said second table portion, in particular said second table portion. Additionally, shoulder straps may be provided to fix a torso of the patient to the apparatus.

The adjustment of the leg movement mechanism may be performed while the first and second table portions are in a horizontal position, i.e. while the patient is lying on the table. By fixing the pelvic region of the patient via the pelvic harness and adjusting the leg mechanism accordingly, a correct centre of rotation may be provided for the leg movement, thus avoiding or reducing shearing forces which may occur when the mechanical centre of rotation and the orthopedically correct center of rotation deviate from each other.

Further features and embodiments will become apparent from the following detailed description with reference to the attached drawings, wherein.

Figure 1:
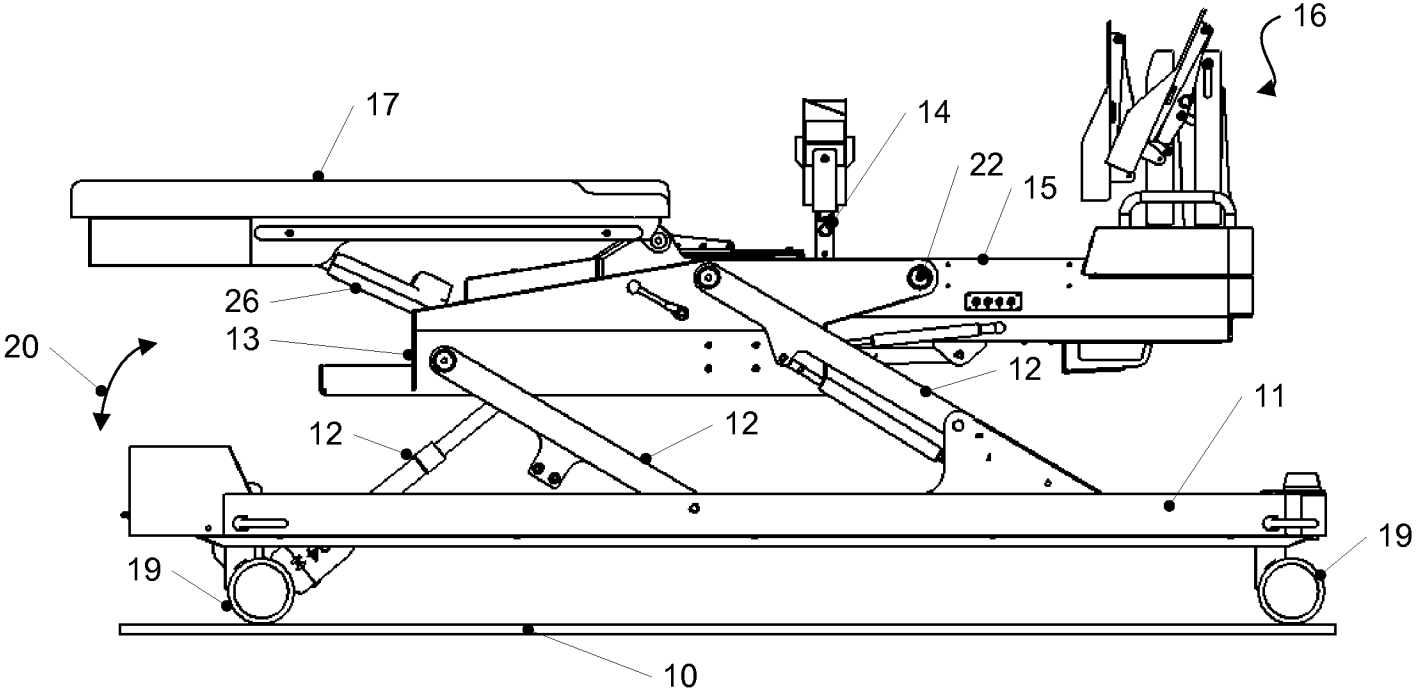
FIG. 1 is a side view of an apparatus according to an embodiment.

In the following, embodiments of the present invention will be described in detail with reference to the attached drawings. It should be noted that these embodiments are given only for the purpose of illustration and are not to be construed as limiting the scope of this application.

It should be noted that features of different embodiments may be combined with each other unless specifically noted otherwise. Furthermore, describing an embodiment with a plurality of features is not to be construed as indicating that all those features are necessary for practicing the present invention, as other embodiments may comprise less features and/or alternative features to the ones shown in the drawings or described herein.

Various components of the embodiments shown are not necessarily drawn to scale with each other, but are depicted in a manner to provide a clear understanding of the respective embodiment.

Turning now to the figures, in FIG. 1-5 various views of an apparatus for locomotion therapy according to an embodiment are shown. In particular, FIG. 1 shows a side view of the apparatus with a table comprising a first table portion 15 and a second table portion 17 being in a horizontal position. In other Figures, other positions of the apparatus are shown. It should be noted that training is possible in various positions, e.g. in the horizontal position shown in FIG. 1 or in tilted or vertical positions described later.

The apparatus of FIG. 1 further comprises a base frame, i.e. a base 11 having wheels 19 for rolling the apparatus on a floor 10. However, in other embodiments, the apparatus may be stationary without having wheels. First table portion 15 is coupled with base frame 11 via a lifting mechanism 12 and a tilting mechanism 13. Using lifting mechanism 12 which comprises rods and actuators, tilting mechanism 13 together with first and second table portions 15, 17 may be lifted in a vertical direction, in this case following an arc as indicated by an arrow 20, i.e. also with a movement component in the horizontal direction.

Furthermore, as will be explained further below, for tilting the table formed by first table portion 15 and second table portion 17 between the horizontal position shown in FIG. 1 and a vertical position, first table portion 15 may be rotated about an axis 22 by tilting mechanism 13. It should be noted that the shown lifting and tilting mechanisms 12, 13 are merely an example, and in other embodiments other mechanisms, for example using more than one axis, may be used to lift and/or tilt first table portion 15 with respect to base 11.

Furthermore, a foot mechanism is mounted to first table portion 15 and configured to receive feet of a patient using the apparatus. Also, a leg movement mechanism 14 which may comprise belts as shown to fix the legs of the person to the mechanism is provided for moving legs of a person using the apparatus, in particular to flex knees of the person to emulate a walking movement, to give an example. The belts may be adjustable to accommodate leg movement mechanism 14 to different leg diameters. Suitable leg movement mechanisms are described in the above-mentioned EP 1 169 003 B1 in detail and will not be described in greater detail here except for an additional adjustment possibility described later with respect to FIG. 6.

Figure 2:
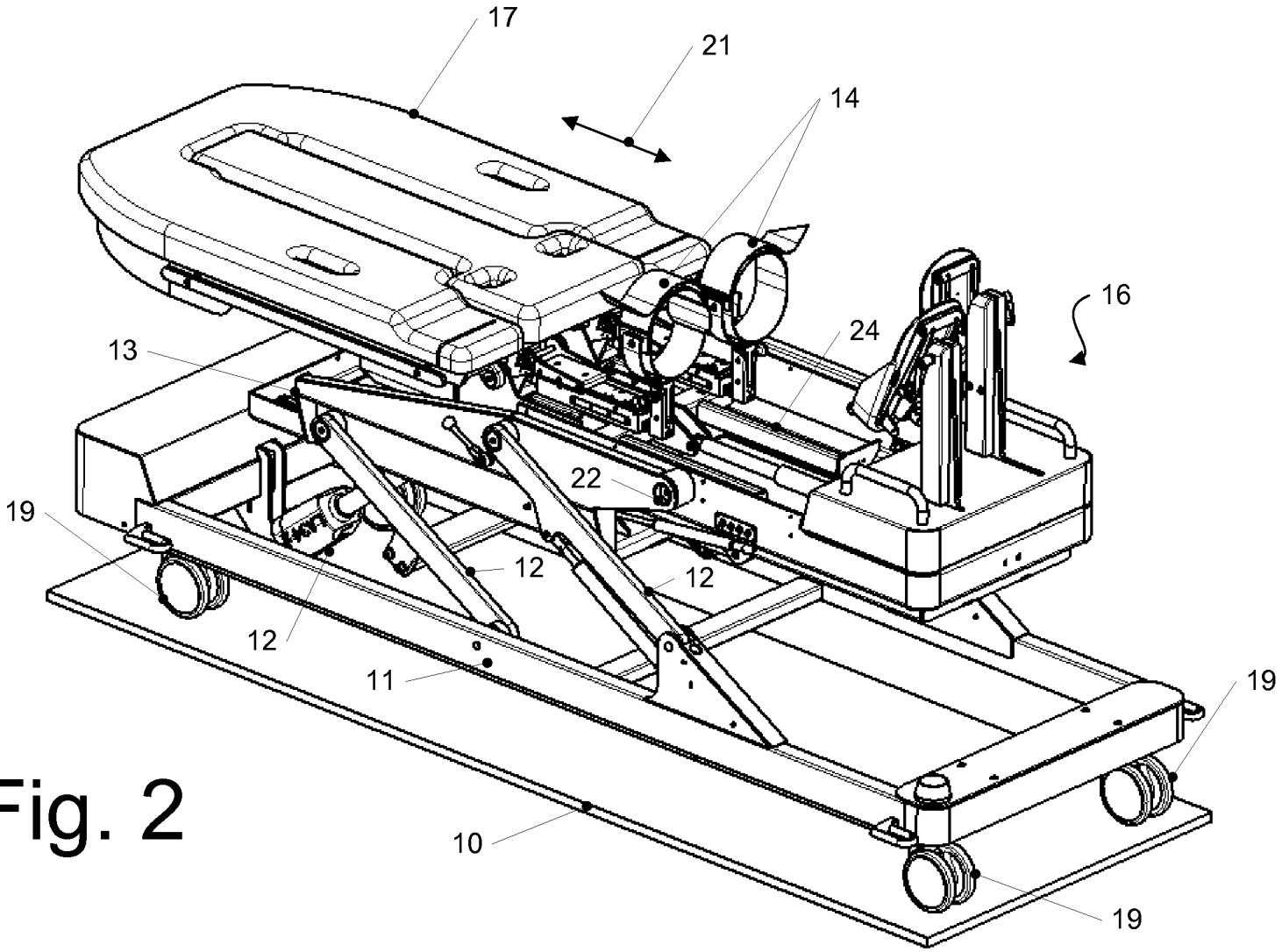
FIG. 2 is a perspective view of the apparatus of FIG. 1.

FIG. 2 shows a perspective view of the apparatus of FIG. 1 in the same position, i.e. tilting mechanism 13 being slightly lifted via lifting mechanism 12 and first and second table portions 15, 17 being in a vertical position. As can be seen in FIG. 2, second table portion 17 is coupled to first table portion 15 via a drive mechanism 24, for example a linear drive. Using drive mechanism 24, the position of second table portion 17 may be adjusted as indicated by an arrow 21 with respect to first table portion 15 to adapt the apparatus to patients of different heights. For example, for taller patients, second table portion 17 which in operation for example accommodates back and head of a person may be moved away from first table portion 15, and for smaller persons it may be moved towards first table portion 15. As first table portion 15 is mounted to tilting mechanism 13 to tilt about axis 22, such an adjustment to accommodate different heights of patients does not change the distance between foot mechanism 16 and axis 22 and therefore, as will be explained in more detail later, helps to keep the position of foot mechanism 16 and therefore of the patient low when tilting first table portion 15.

Figure 3:
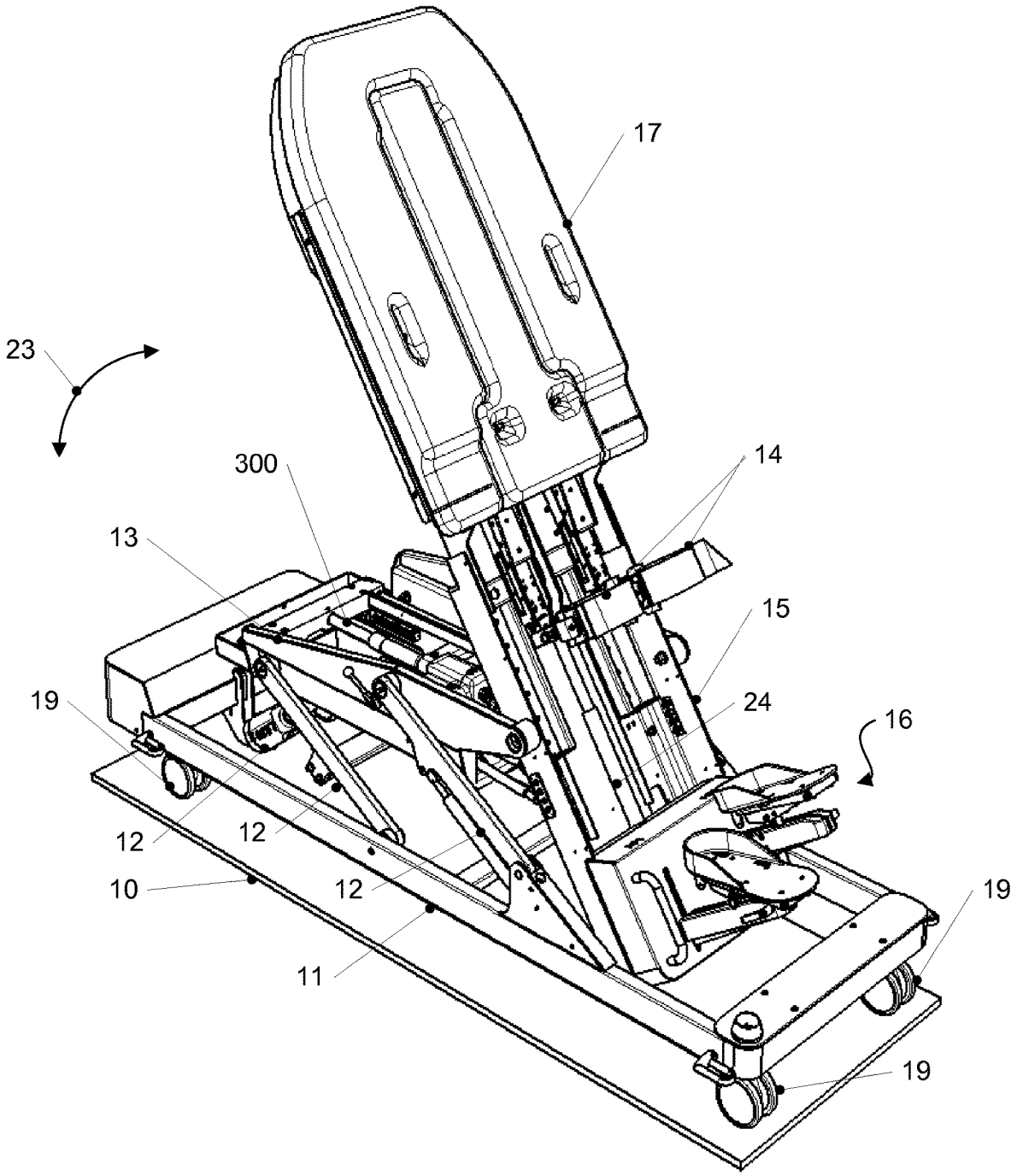
FIG. 3 is a perspective view of the apparatus of FIG. 1 with a table in an intermediate position.

The result of such a tilting motion is shown in FIG. 3. Here, lower table portion 15 has been tilted about axis 22 as indicated by an arrow 23 by tilting mechanism 13, in particular by using a drive 300 of tilting mechanism 13, to a position between a horizontal position and a vertical position, for example a position of about 45 degrees.

Figure 4:
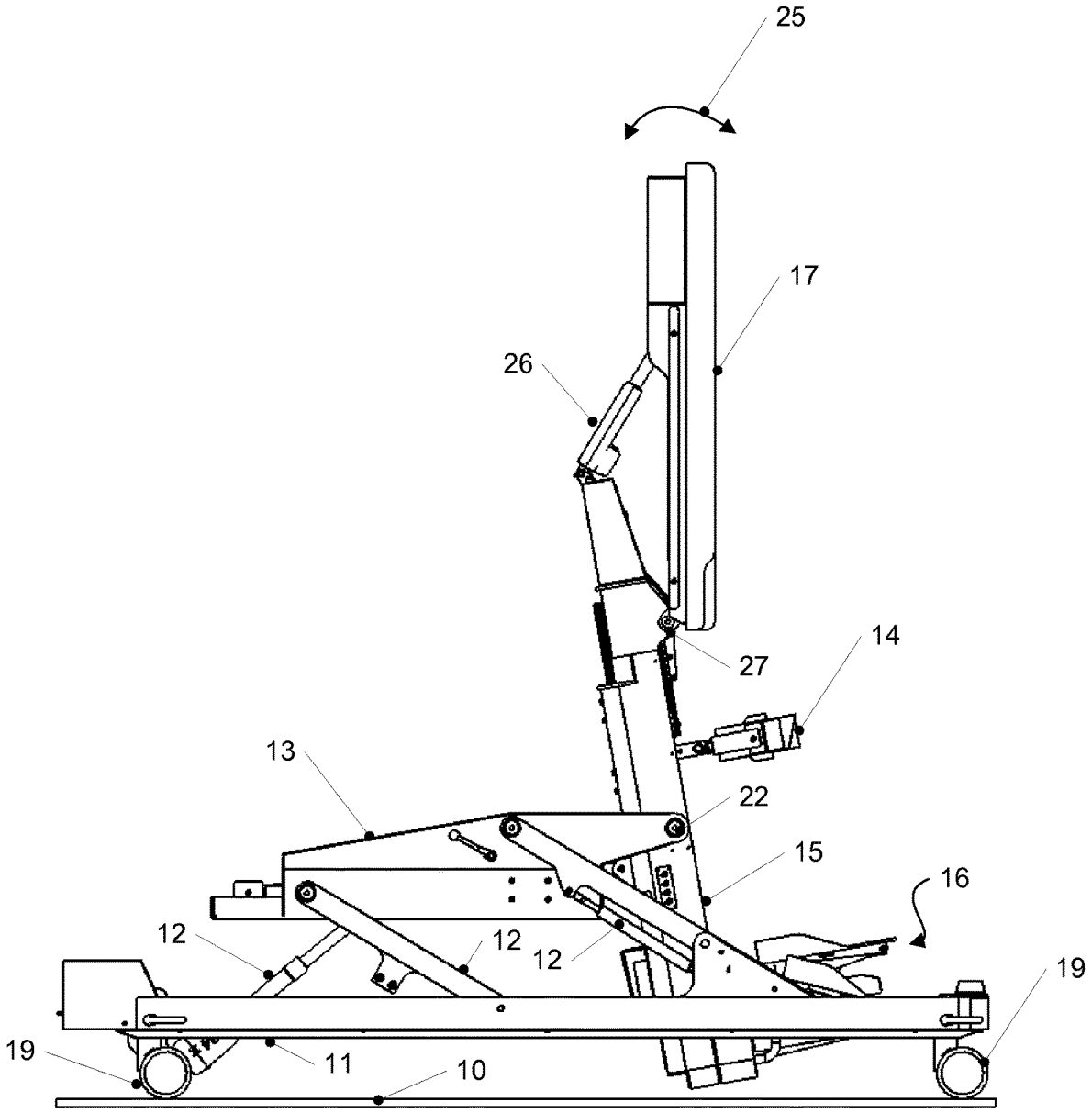
FIG. 4 is a side view of the apparatus of FIG. 1 with the table in a near vertical position.

In FIG. 4, the first table portion 15 and therefore also the second table portion 17 connected thereto are shown in an almost vertical position. Also, as shown in FIG. 4 using a mechanism 26, for example a further linear drive, second table portion 17 may be tilted as indicated by an arrow 25 with respect to first table portion 15 about an axis 27. In this way, an extension or flexion of a hip joint of a patient may be adjusted (hereinafter shortly referred to as "hip extension" and "hip flexion", respectively). A hip extension may for example be increased by tilting second table portion 17 backwards, i.e. to the left side in FIG. 4, while a hip flexion may be increased by tilting second table portion 17 forward, i.e. to the right side in FIG. 4. In some embodiments, in this way even an "overhanging" patient position may be reached if desired. In other embodiments, mechanism 26 may be omitted, for example be replaced by a rigid element, such that the angular relationship between first and second table portions 15, 17 is fixed.

Also, as can be seen in FIG. 4, foot mechanism 16 is close to floor 10, which is achieved by tilting first table portion 15 and performing any height adjustment by adjusting the position of second table portion 17 relative to first table portion 15. Adjusting the vertical position of tilting mechanism 13 and therefore of axis 22 may additionally contribute to keep foot mechanism 16 and therefore the patient close to floor 10.

Figure 5:
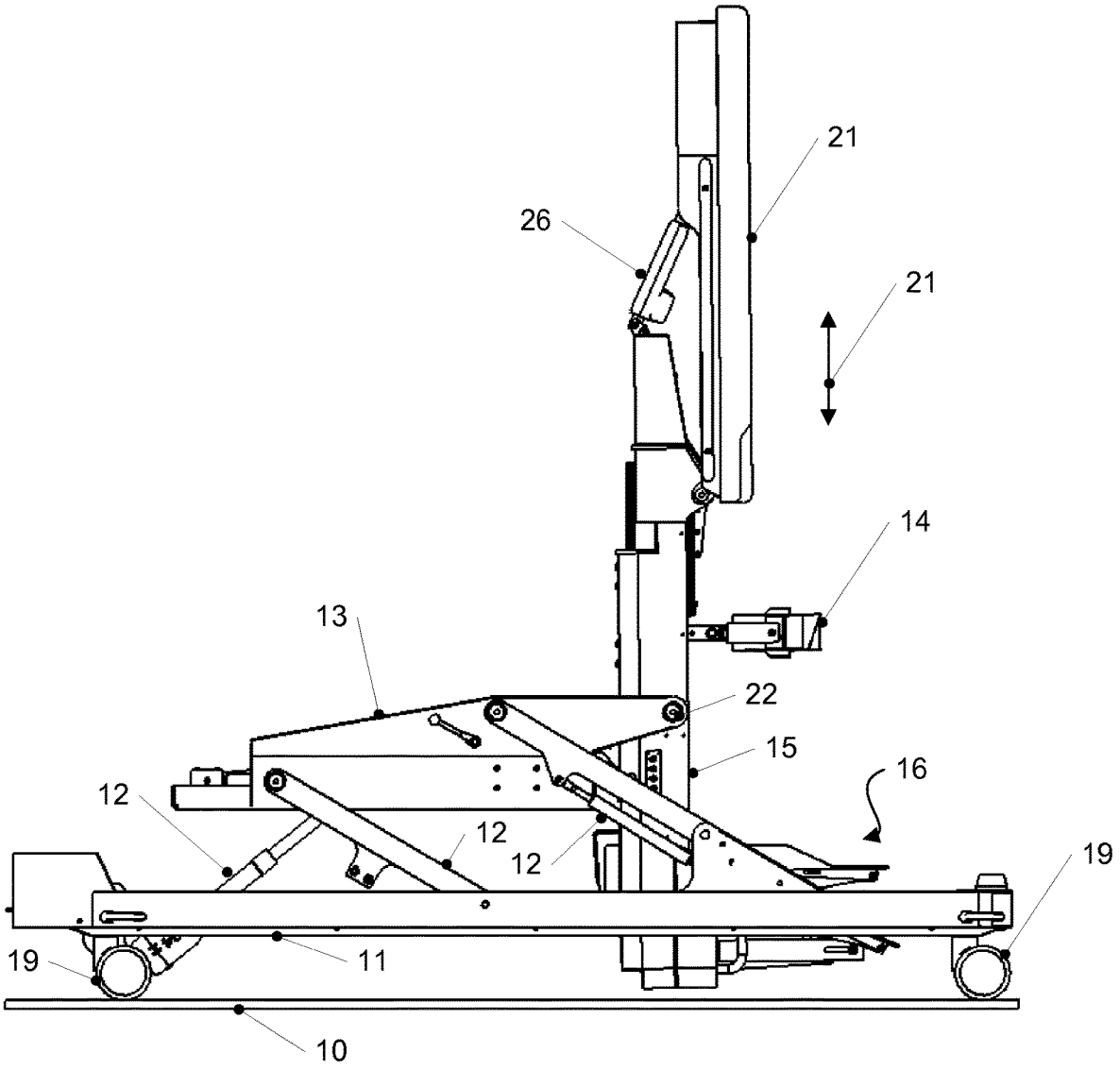
FIG. 5 is a side view of the apparatus of FIG. 1 with the table in a vertical position.

Finally, in FIG. 5 first table portion 15 is tilted to a completely vertical position. It should be noted that also in this position or in all intermediate positions, second table portion 17 may be adjusted with respect to first table portion 15 as indicated by arrow 21.

It should be noted that the various drive mechanisms used for performing the adjustments and movements described with reference to FIG. 1-5 may comprise electric motors, pneumatic elements or other actors. It is also conceivable that some of these elements are adjusted manually, for example by providing a crank lever and a corresponding gear mechanism.

In the following, with respect to FIG. 6-16, various optional additional features which may in some embodiments be implemented in the apparatus of FIG. 1-5 will be described. It should be noted that these optional additional features may not only be implemented in the apparatus of FIG. 1-5, but also in other apparatuses for locomotion therapy which enable a movement or tilting of a person between a horizontal position and a vertical position, for example the apparatus of the above-mentioned EP 1 169 003 B1. It should further be noted that the various features described with reference to FIG. 6-12 may be used independently from each other, but also combinations of some or all of these features may be used. Nevertheless, for ease of reference these optional features will be described with respect to the embodiments of FIG. 1-5.

Figure 6:
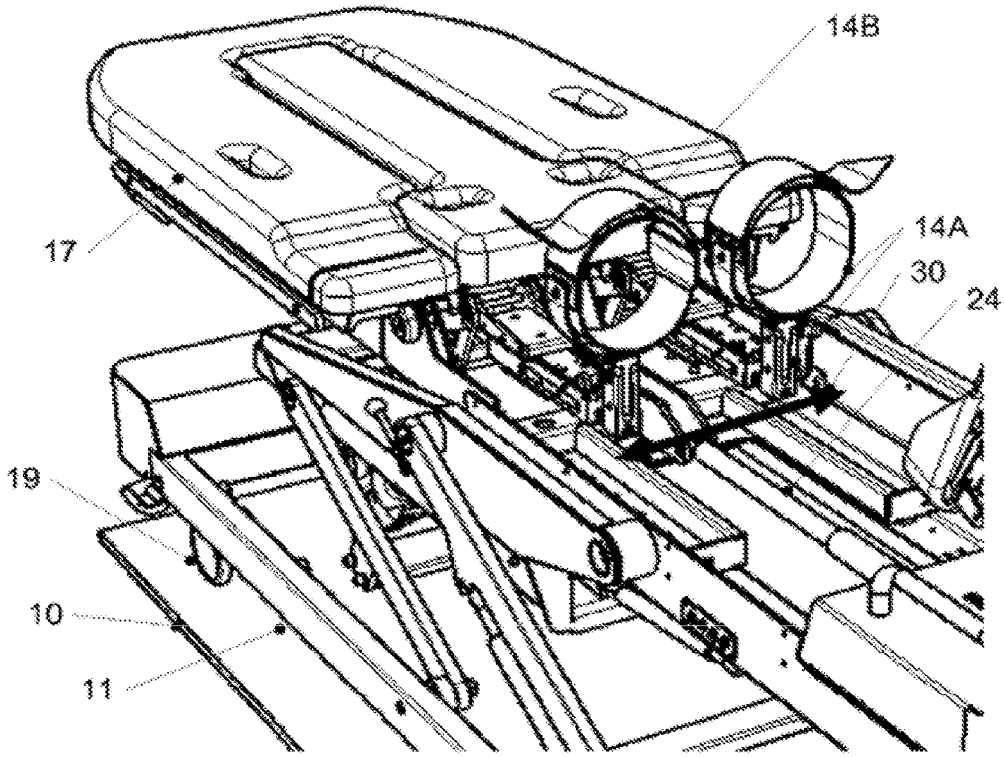
FIG. 6 is a partial view of an apparatus according to an embodiment for illustrating an adjustment of a leg movement mechanism.

In FIG. 6, an optional adjustment possibility for a leg movement mechanism is shown. In the embodiment of FIG. 6, the leg movement mechanism comprises a first mechanism 14A for a left leg of the patient and a second mechanism 14B for a right leg of the person. These mechanisms themselves may work as in the above-mentioned EP 1 169 003 B1, e.g. move to flex and extend a knee of a person and for example be driven by eccentric drive. As indicated by an arrow 30 in FIG. 6, a distance between first and second mechanisms 14A and 14B is adjustable to accommodate the apparatus to different "track widths" of patients. Such an adjustment may for example be provided by mounting leg mechanisms 14A, 14B slidably in tracks or bearings or using a drive mechanism using a gear rack. However, other adjustment mechanisms are also possible.

Figure 7:
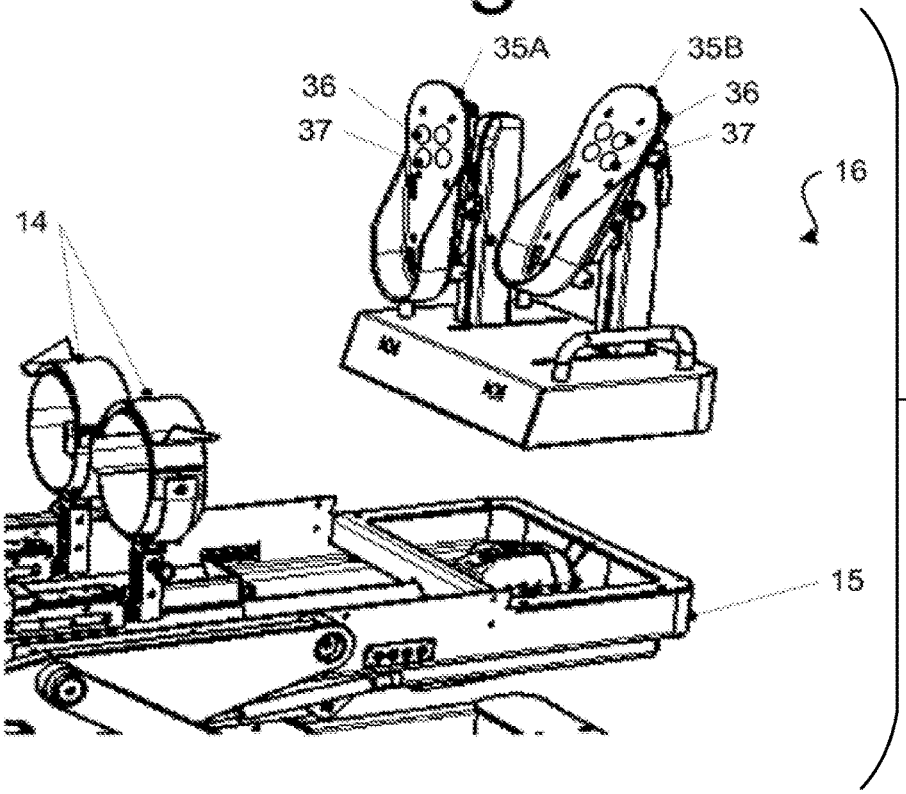
FIG. 7 is a partial view of an apparatus according to an embodiment illustrating an embodiment of a foot mechanism.
Figure 8:
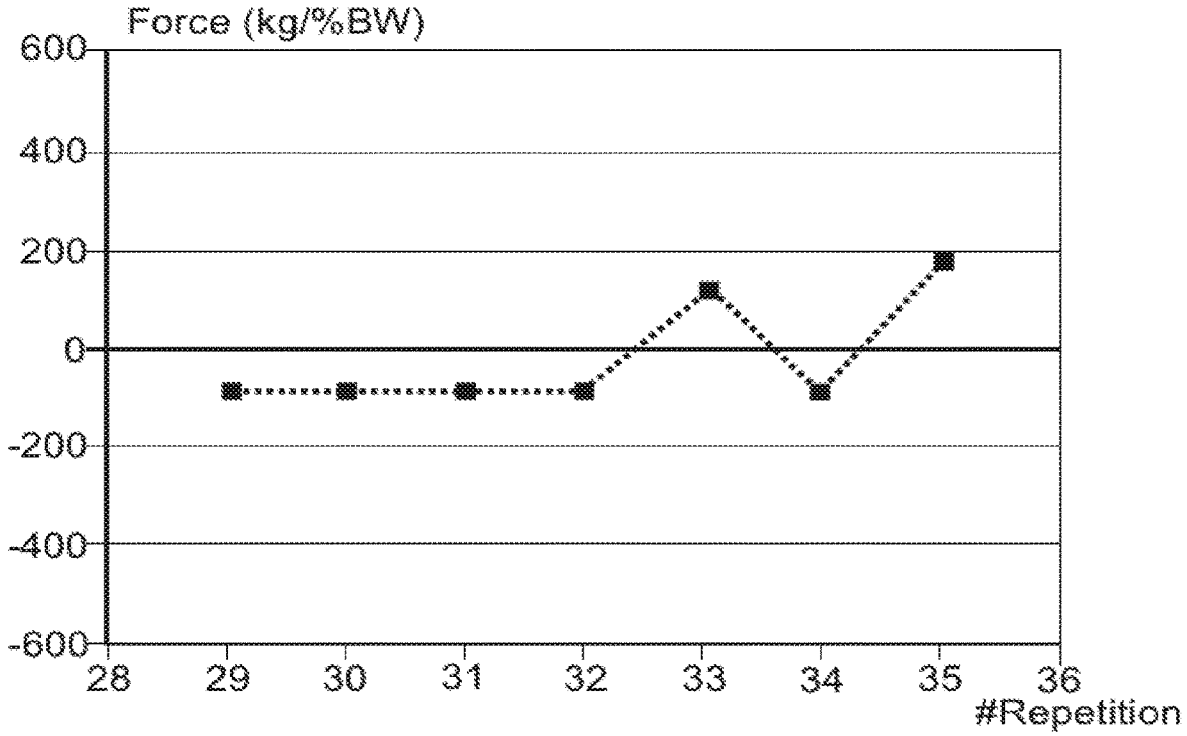
FIG. 8 is a diagram illustrating loading of an apparatus according to an embodiment.

In FIG. 7, a specific implementation of a foot mechanism 16 is shown. In the embodiment of FIG. 7, foot mechanism 16 comprises a first footrest 35A for a left foot of a person and a second footrest 35B for a right foot of the person. In footrests 35A, 35B load sensors 36 may be provided to measure a load caused by the patient, i.e. a force which is exerted by the patient on footrest 35A and/or 35B. With cyclic exercises like a cyclic flexion and extension of the knee the force relative to the body weight may be plotted over the number of repetitions as shown as an example in FIG. 8. In such a way, a good control and documentation of the therapy is possible.

In other embodiments, instead of or in addition to load sensors 36 provided in footrests 35A, 35B other kind of load sensing mechanisms may be used for measuring the load. For example, a load may be measured indirectly by measuring a displacement of footrests 35A, 35B caused by a load e.g. by measuring an angle or using potentiometers and taking a restoring force of springs or other resilient elements biasing footrests 35A, 35B towards a predetermined standby position into account, or by sensing a force or a torque at another point in the foot mechanisms than directly at footrests 35A, 35B.

In addition to sensors 36 or as an alternative thereto, footrests 35A, 35B may also comprise mechanical stimulation elements 37. Through such mechanical stimulation elements, pressure may be exerted locally and selectively to various areas of the soles of the feet of the person. Such a stimulation may in particular be performed synchronously with the movement of the leg movement mechanism, such that the mechanical stimulation of the soles of the feet may simulate the feeling of rolling the foot from heel to toe while walking, thus being in synchronicity with the walking movement emulated by the leg movement mechanism. It is to be noted that such a synchronous control of the leg movement mechanism and the mechanical stimulation of the soles of the feet is not restricted to cyclic movements or stimulations, but also other kinds of coordinated control also are considered as being a synchronous control within the scope of this application. For example, foot stimulations simulating a stumbling may be inserted at certain points of the movement of the leg movement mechanism, or the leg movement mechanism itself may be controlled to simulate a stumbling or other event.

Figure 9A:
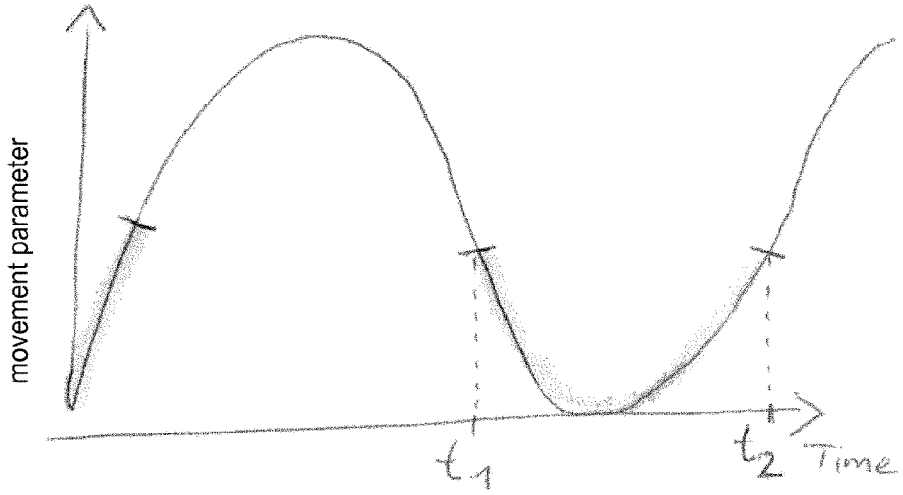
FIG. 9A-9C show examples for a foot stimulation.

In particular, possibilities for foot stimulations will now be explained with reference to FIG. 9 in more detail. FIG. 9A shows a movement parameter like an amplitude or a position of a leg movement mechanism over time, a high amplitude for example corresponding to a flexed knee and a low amplitude corresponding to a more extended knee. A foot stimulation may for example be performed in portions with lower amplitude, for example between times $t_1$ and $t_2$ of each cycle of the leg movement mechanism. The remaining time, for example the higher amplitudes, may for example correspond to phases of the walking movement where the foot would be lifted from the ground. Consequently, in these times no foot stimulation is performed, i.e. no additional pressure is exerted on the foot.

Figure 9B:
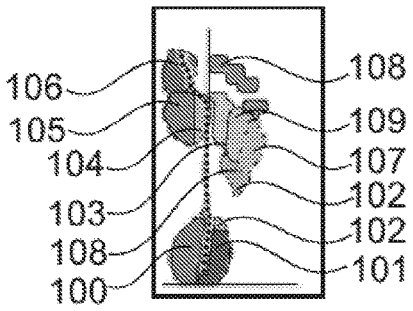
Figure 9C:
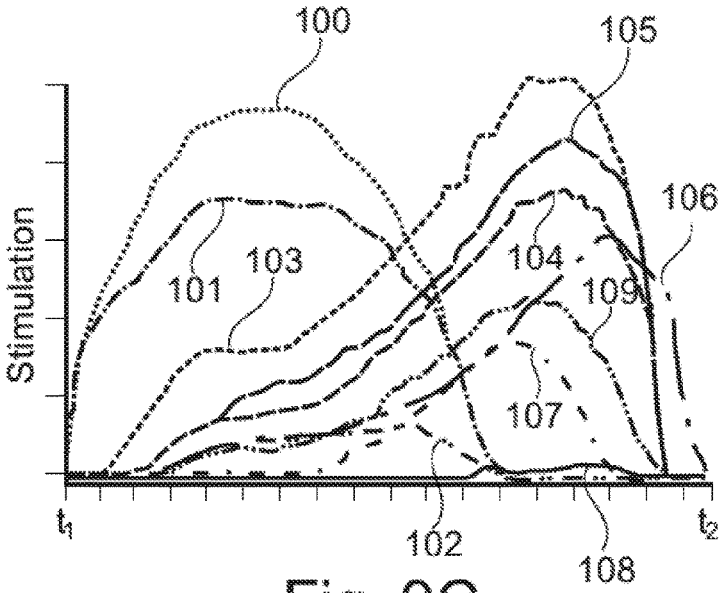

Between $t_1$ and $t_2$, stimulation may start at the heel and then move to the tip of the foot. Heel and tip of the foot may be divided in different portions which are stimulated at different times and/or with different intensities. An example for this is shown in FIGS. 9B and 9C, where FIG. 9B shows various zones of a foot (in this case a right foot) and FIG. 9C shows corresponding stimulation curves for the zones. A zone and its associated stimulation curve (intensity of stimulation over time) bear the same reference numeral 100-109. However, the partitioning of the foot into zones and the stimulation curves shown in FIG. 9C serve only as examples, and in other embodiments, other partitionings or stimulation curves, for example partitionings with less zones or more zones, are possible.

In some embodiments, also an electrical stimulation of muscles of the patient, in particular leg muscles, is used. Such an electrical stimulation is also known as functional electrical stimulation (FES).

Figure 10:
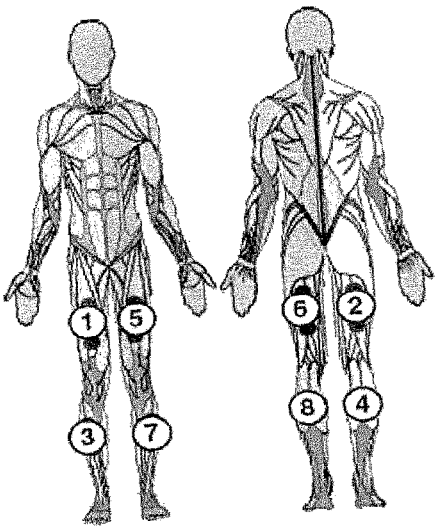
FIG. 10 is a schematic diagram showing various muscles which may be stimulated in an embodiment.

For example, in FIG. 10, a front view and a back view of a person are schematically shown with muscles groups marked by 1-8. These muscle groups may for example be stimulated synchronously with the leg movement mechanism 14 of the preceding embodiments.

For example, regarding the muscles groups shown in FIG. 10, during a phase of increasing amplitude of the leg movement as shown in FIG. 9A (positive slope), muscles groups 2, 4, 6 and 8 may be stimulated, and during a phase of falling amplitude (negative slope) of FIG. 9A muscles groups 1, 3, 5 and 7 may be stimulated via electrodes to which a corresponding voltage is applied. However, this stimulation scheme serves only as an example, and for example in other embodiments only some of the muscle groups depicted may be stimulated.

Figure 11:
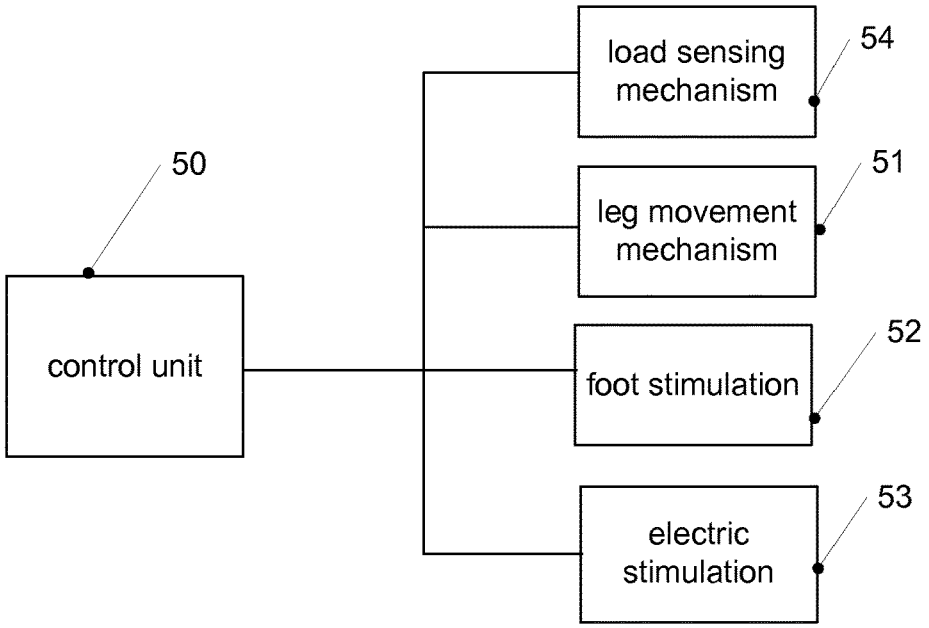
FIG. 11 shows a block diagram of some features of some embodiments.

In FIG. 11, a block diagram of a part of an embodiment employing foot stimulation and electric stimulation is depicted. A control unit 50, for example a correspondingly programmed microprocessor, controls a leg movement mechanism 51, for example leg movement mechanism 14 of the embodiments of FIG. 1-5. Additionally, control unit 50 controls a foot stimulation 52, for example the foot stimulation explained with reference to FIGS. 7 and 9, synchronously with leg movement mechanism 51. Additionally or alternatively to foot stimulation 52, control unit 50 may also control an electric stimulation 53 synchronously with leg movement mechanism 51, for example as explained with reference to FIG. 10. It should be noted that in other embodiments, foot stimulation 52 and electric stimulation 53 may be omitted. Additionally, control unit 50 may receive signals from a load sensing mechanism 54 which may be implemented as described above with reference to FIG. 7.

Next, with reference to FIG. 12A-12C a specific embodiment of a foot mechanism 16 will be described. This foot mechanism may be employed in the embodiment of FIG. 1-5, but may also be employed in other apparatuses for locomotion therapy. Moreover, the foot mechanism of FIG. 12A-12C may be combined with the load sensors and/or the mechanical foot stimulation of FIG. 7, but may also be used without these features.

Figure 12A:
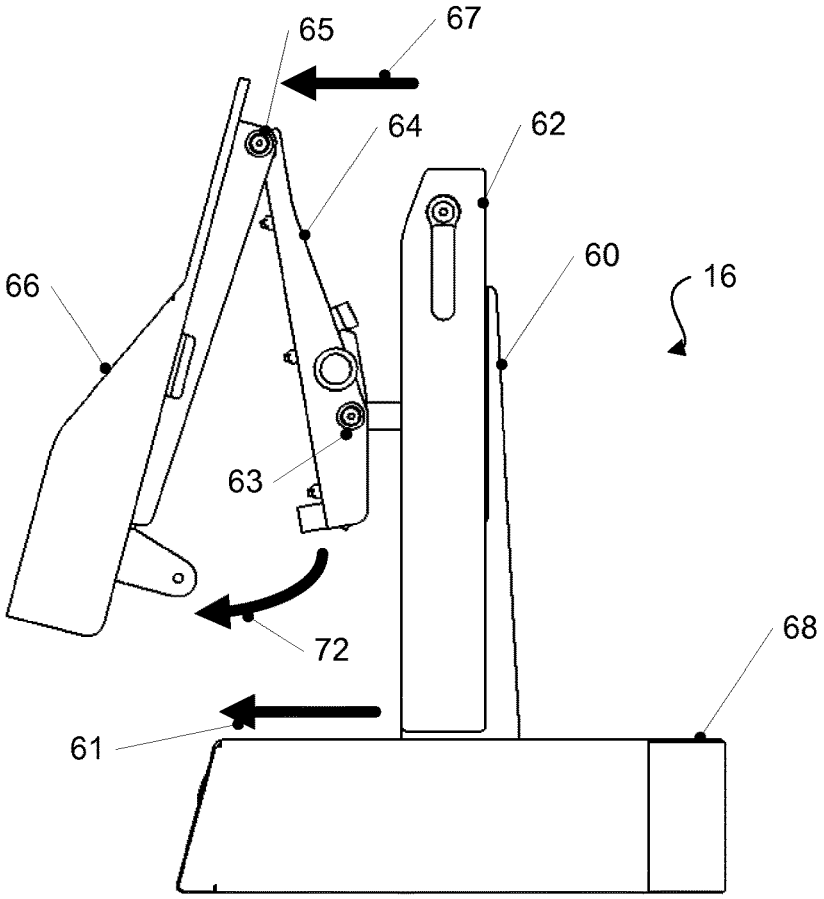
FIG. 12A-12C show a particular embodiment of a foot mechanism in three different positions.
Figure 12B:
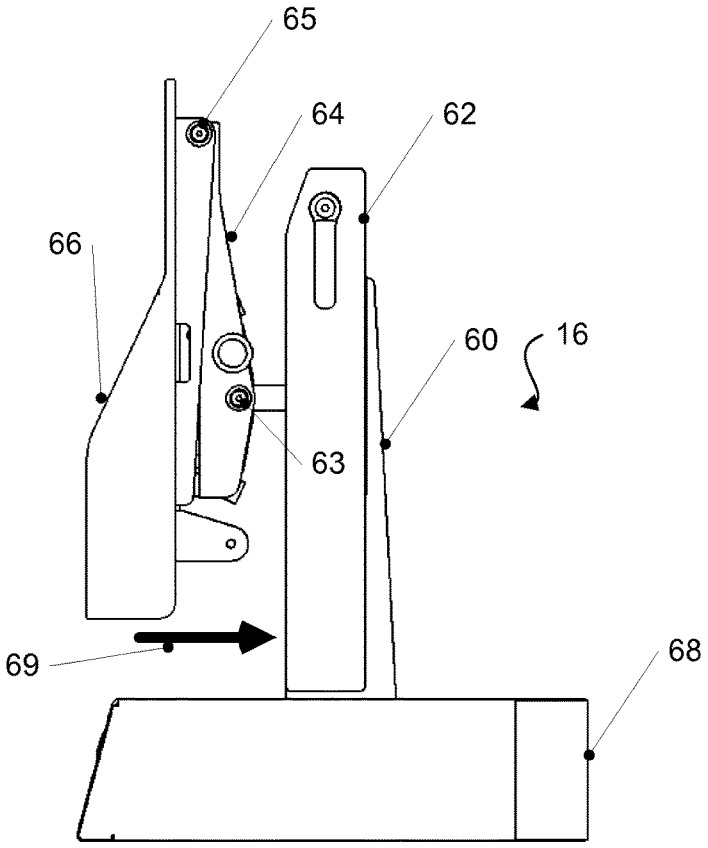
Figure 12C:
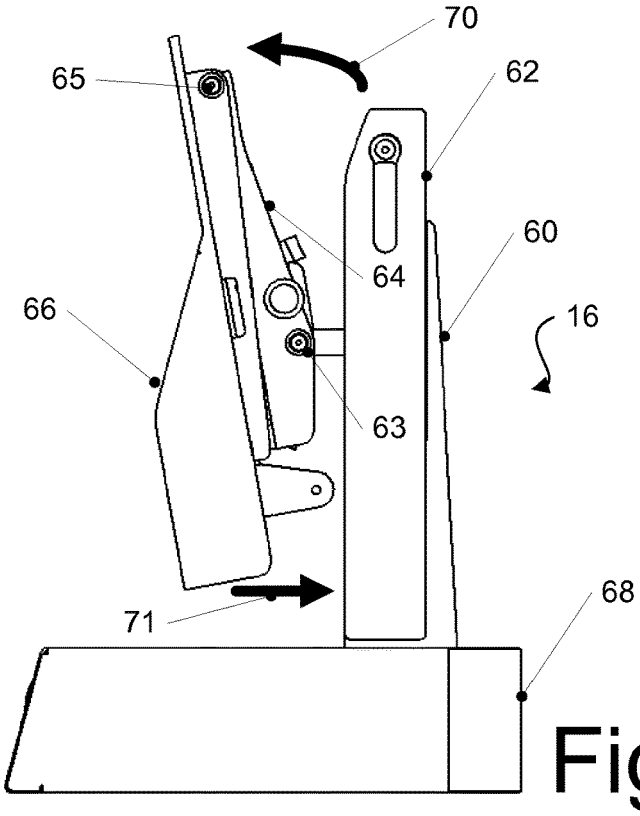

FIG. 12A-12C show foot mechanism 16 in three different positions corresponding to three different phases of a cycle of the leg movement mechanism, for example. While in FIG. 12A-12C only a single mechanism for one foot is shown, two such mechanisms may be provided, one for the left foot and one for the right foot of the patient.

The foot mechanism 16 of FIG. 12A-12C comprises a mounting portion 68 to be mounted for example to first table portion 15 of the embodiment of FIG. 1-5. For the mechanism, a base portion 60 in form of a ridge is slidably mounted on mounting portion 68. Fixed to base portion 60 is an intermediate portion 62. A footrest 66 is coupled with intermediate portion 62 and therefore with base portion 60 via a double joint comprising, in the embodiment of FIG. 12A-12C a first joint 63 at intermediate portion 62, and a second joint 65 at a tip portion (i.e. a portion where the tip of the foot rests) of footrest 66. Joints 63, 65 are connected via an elongate member 64, for example a rod or an elongate plate. When footrest 66 is essentially parallel to intermediate portion 62 as shown in FIG. 12B, joint 63 is closer to a heel portion of footrest 66 than to the tip portion. Joints 63, 65 may for example comprise hinges.

Through the sliding movement of base portion 60 on mounting portion 68 and the double joint between footrest 66 and intermediate portion 62, in some cases a disadvantageous positioning of a lower leg of the person may be prevented and damages to the knee may be prevented in some cases.

For example, in FIG. 12A a movement for a flexion or bending of the knee (which may be initiated by leg movement mechanism 14 of FIG. 1-5) is shown. In this case, base portion 60 as indicated by an arrow 61 slides upward (towards a head of the patient), footrest 66 moves away from intermediate portion 62 and base portion 60 as indicated by an arrow 67, and footrest 66 tilts as indicated by an arrow 72. In contrast thereto, in FIG. 12B the situation for a knee extension, i.e. a straightening of the knee, is shown. Here, base portion 60 slides downward (away from the head of the patient) on mounting portion 68 as indicated by an arrow 69, and footrest 66 is parallel and close to intermediate portion 62.

In FIG. 12C, the foot mechanism is shown in a position that corresponds to a dorsal extension of the ankle joint of a patient. Here, also base portion 60 moves slidingly on mounting portion 68 as indicated by an arrow 71, and footrest 66 tilts as indicated by an arrow 70, which corresponds to a lifting motion of the tip of the foot.

Other kinds of movements may also be enabled by the foot mechanism of FIG. 12A-12C.

It should be noted that such a foot mechanism may be a passive foot mechanism, i.e. the movement may be caused for example by the leg movement mechanism, and the feet pull/push the foot mechanism accordingly, or active components like electric motors may be provided to actively control the movements of the foot mechanism, for example movements as explained with reference to FIG. 12A-12C. In such a case, also the foot mechanism may be controlled by a control unit like control unit 50 of FIG. 11 synchronously to the leg movement mechanism.

It should be noted that joints 63, 65 of the double joint may be configured to be arrestable to fix the foot mechanism in a desired position. Furthermore, one or more resilient stoppers, for example springs, may be provided to allow for a smooth deceleration with reduced force acting on the foot when footrest 66 reaches an end of a movement range, for example the position of FIG. 12B. Such forces acting on the foot may provide an additional stimulus.

Figure 13A:
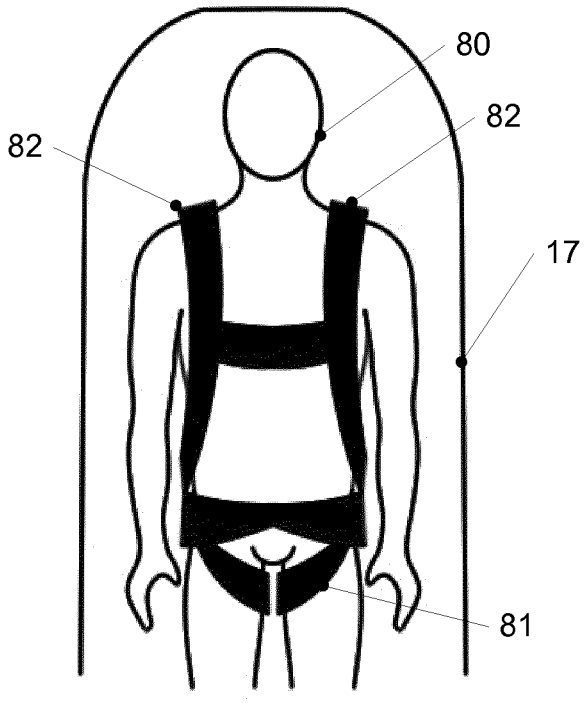
FIGS. 13A and 13B show pelvic harnesses usable in some embodiments.
Figure 13B:
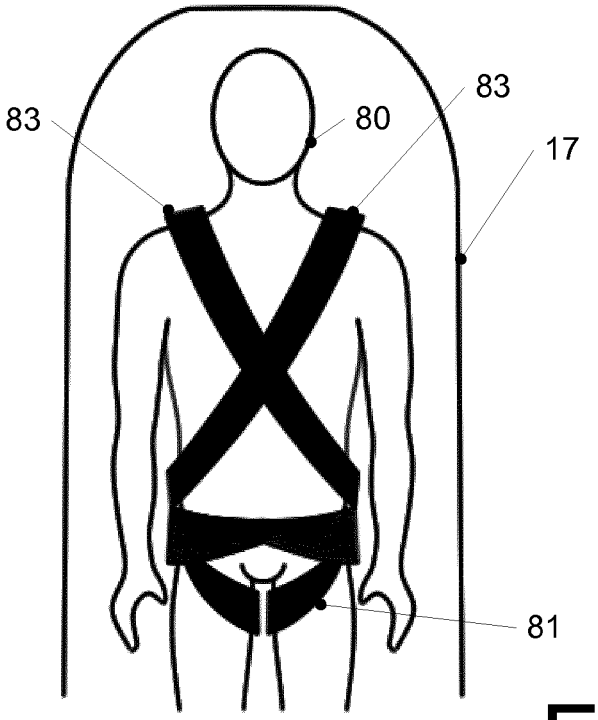

Various possibilities may be employed for fixing a patient to the apparatuses described so far with reference to FIG. 1-12. For example, a patient may be fastened to the apparatus using a harness as described in the above-mentioned EP 1 169 003 B1, where the patient is essentially suspended from above. A further possibility used in some embodiments is shown in FIGS. 13A and 13B. Here, the patient is fixed to the apparatus, in particular to second table portion 17, via a pelvic harness 81. The pelvic harness 81 is directly fixed to the apparatus, for example second table portion 17. To prevent a tilting of the torso, shoulder straps may be provided. For example, in FIG. 13A straight shoulder straps 82 are provided for fixing patients 80 whereas in FIG. 13B crossed-shoulder straps 83 are provided.

In addition to this fastening mechanism which generally fastens patient 80 to the apparatus, specific body parts of the patient may be additionally fastened to the apparatus. For example, the legs may be fastened to the leg movement mechanism, the feet may be fastened to the foot mechanism, and/or a head of the patient may be additionally fastened, which may be particularly helpful for training in the vertical position. For such fastenings, for example velcro strips or similar devices may be used. Also, paddings may be used to make the patient more comfortable and to prevent pressure sores.

Also the fastenings of FIGS. 13A and 13B may be used in conjunction with the previously described embodiments, but also independently therefrom.

Figure 14:
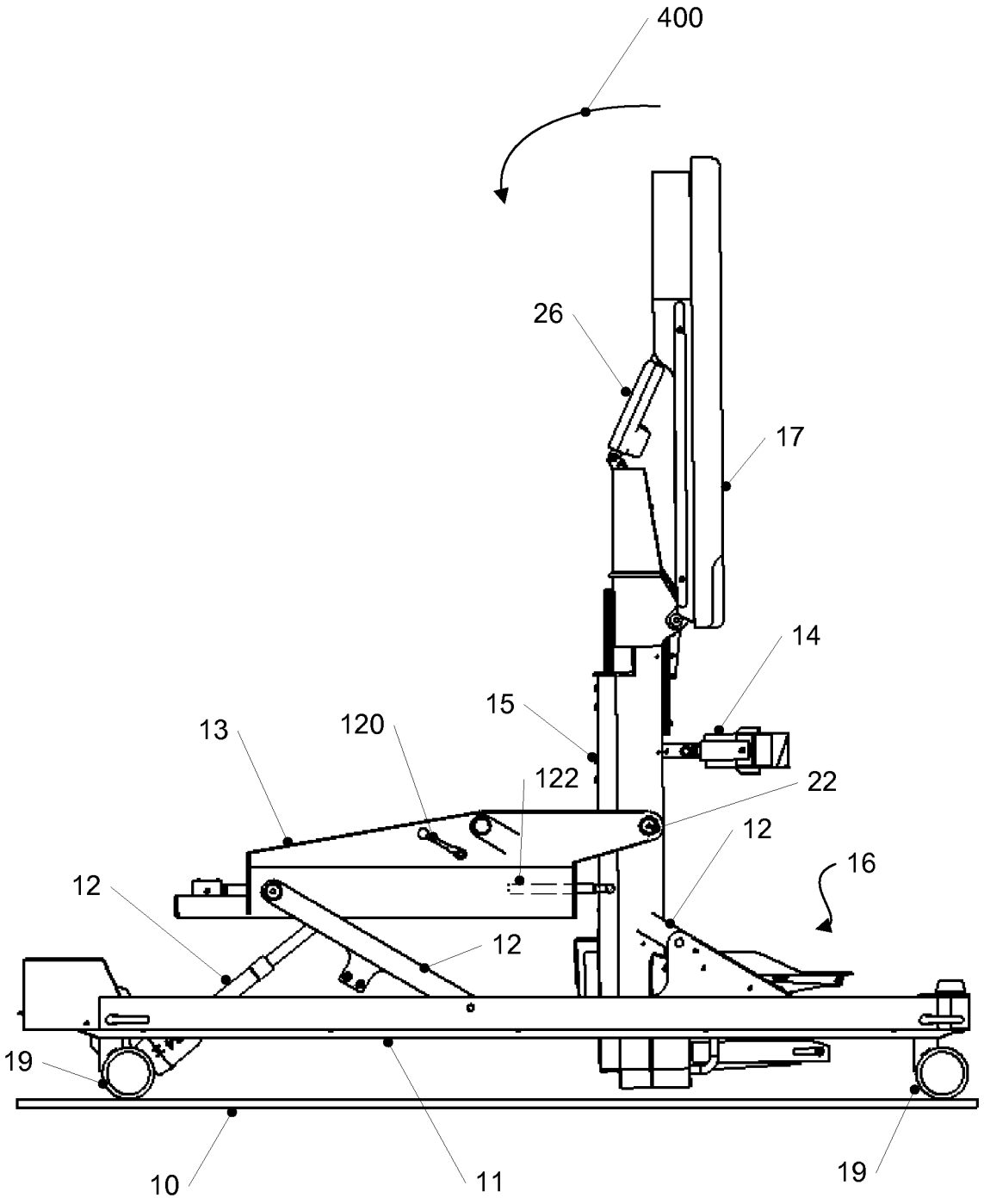
FIG. 14 is a side view of an apparatus according to an embodiment illustration an emergency lowering mechanism.

In some embodiments, an emergency lowering mechanism may be provided which may be used to lower the first and second table portions 15, 17 and therefore the patient from a vertical or tilted position to a horizontal position as shown in FIG. 1 even when actuators like drives used for tilting (or lifting) fail, for example due to a power failure. Such a mechanism is schematically shown in FIG. 14. The embodiment of FIG. 14 corresponds to the embodiment already discussed with reference to FIG. 1-5, which some additional elements as explained below. In FIG. 14, lifting mechanism 12 is only partially shown for a clearer representation of the emergency lowering mechanism.

For performing an emergency lowering of the patient from the vertical position shown in FIG. 14, a lever 120 is operated by a person, for example a therapist supervising the training. To initiate the movement from the vertical position, a gas cylinder 122 or similar, preferably power-independent actuating element is provided. When the movement has been initiated in a direction indicated by an arrow 400 and the first and second table portions 15, 17 are in a tilted position such that a centre of gravity of the patient in the view of FIG. 14 is on the left side of axis 22, the weight of the patient additionally supports and drives the movement. To prevent the movement from becoming to fast, the actuators or drives used in normal operation of the apparatus for tilting, like drive 300 of FIG. 3, may damp the movement, or additional dampers may be provided. To enable such a movement, the actuators and drives like drive 300 may be configured such that they allow a movement when e.g. power fails.

Figure 15:
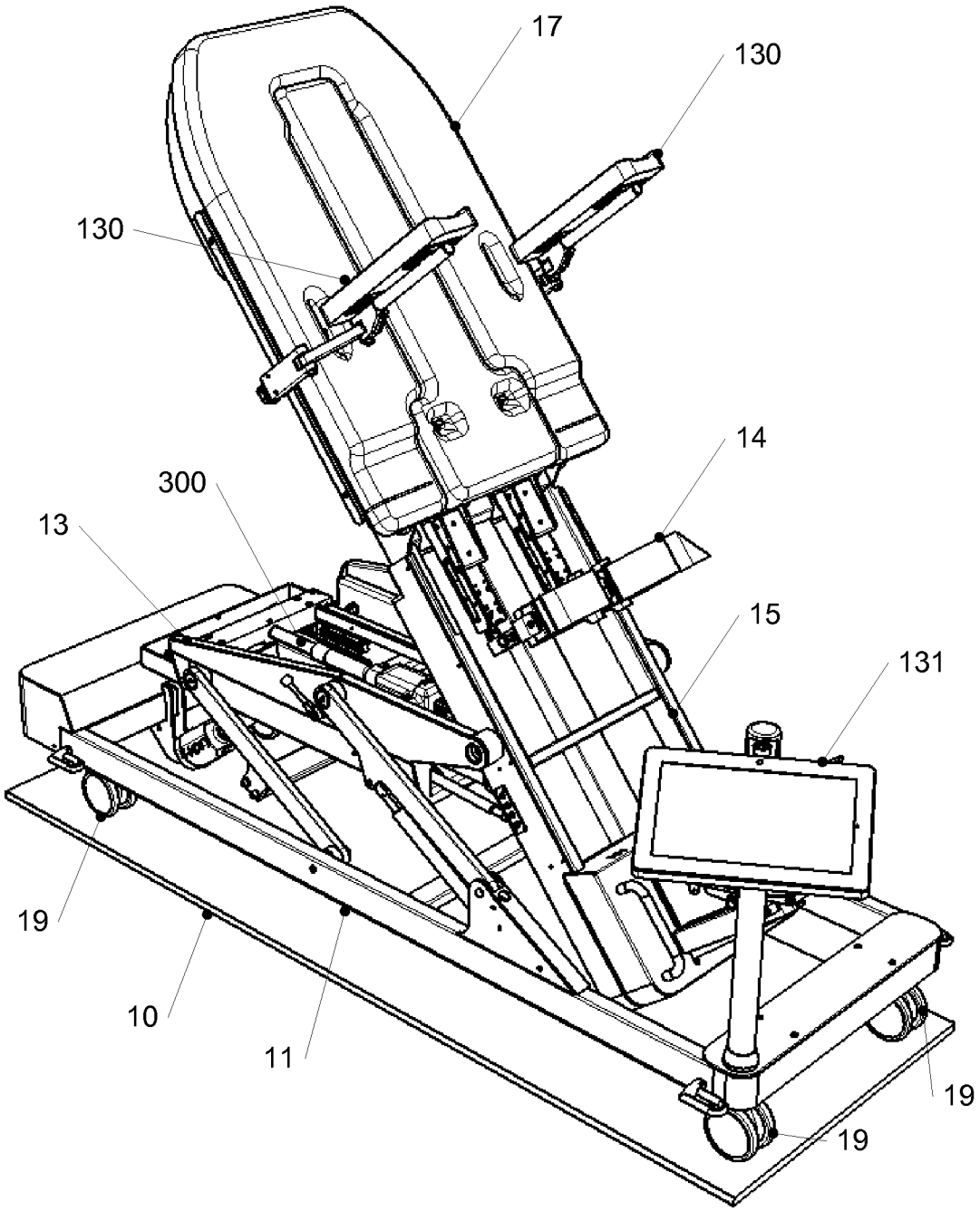
FIG. 15 is a perspective view of an apparatus according to an embodiment.
Figure 16:
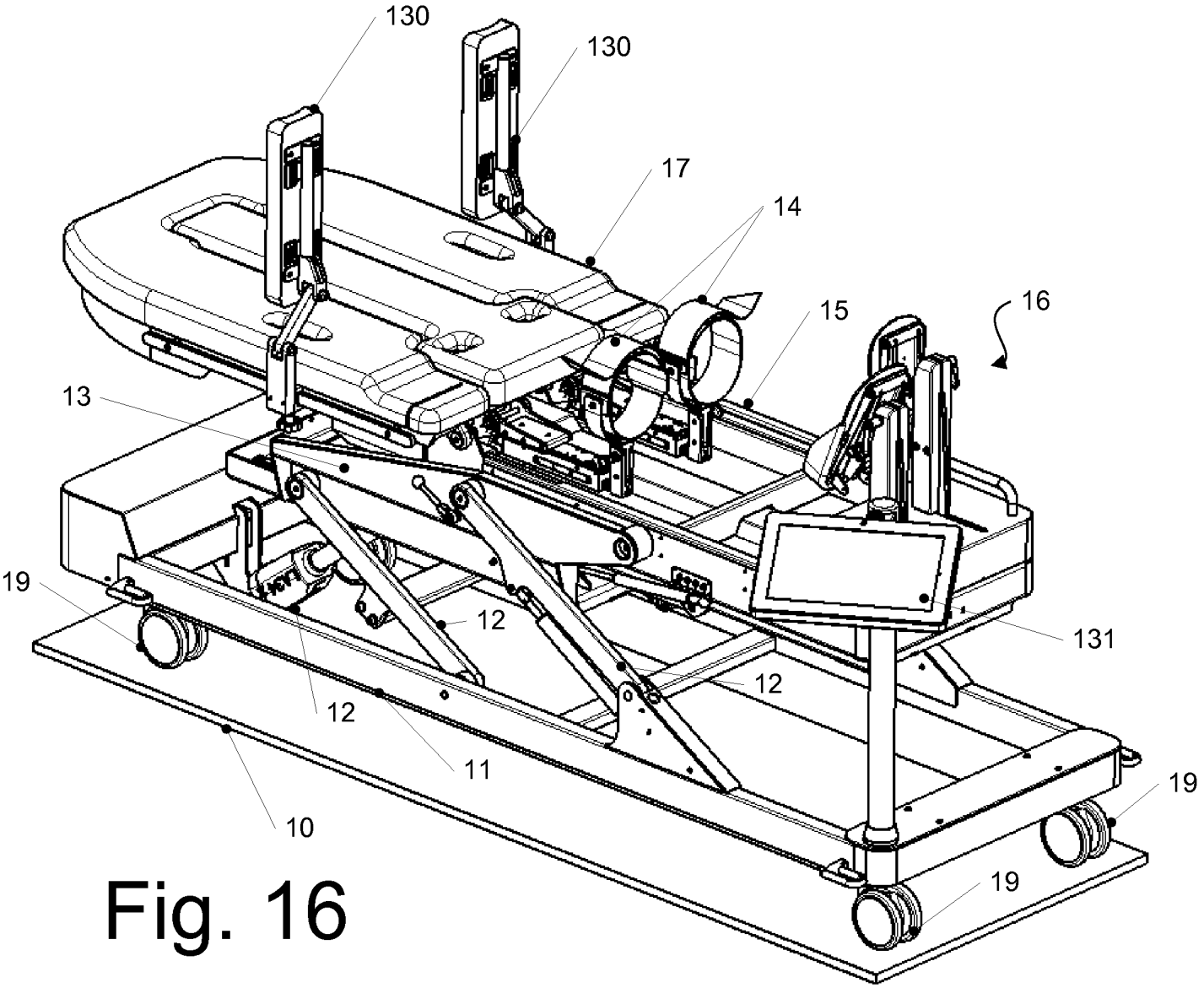
FIG. 16 is a further perspective view of the apparatus of FIG. 15.

Further optional features of some embodiments are shown in FIGS. 15 and 16. FIG. 15 shows a perspective view of an apparatus according to an embodiment with first table portion 15 in a position tilted about 60 degrees to horizontal, and FIG. 16 shows the embodiment in a vertical position. The embodiment of FIGS. 15 and 16 is based on the embodiment of FIGS. 1-5, and only additional features will be discussed in the following.

In addition to features already described, the embodiment of FIGS. 15 and 16 comprises armrests 130. Arms of a person in some embodiments may be fixed to armrests 130 using belts, Velcro straps or similar devices.

Furthermore, the embodiment of FIGS. 15 and 16 comprises a panel 131 for monitoring and/or operating the apparatus. Panel 131 may comprise a so-called touchscreen to allow user input and operating of the apparatus while also being usable to display information regarding the status of the apparatus and/or of the patient training. For example, the curves of FIG. 8 may be displayed. In other embodiments, panel 131 may comprise a conventional display and other input elements like a keyboard. Panel 131 may also be located differently than shown. In still other embodiments, panel 131 may be omitted, and the apparatus may be controlled via a remote device like a computer or a handheld device which is linked to the apparatus in a wireless or wire-based manner. In still other embodiments, both a panel and a remote device may be used.

While various embodiments have been described in detail, it is emphasized again that these embodiments serve only for illustration purposes and are not to be construed as limiting the scope of the present application.

The invention claimed is:

1. An apparatus for locomotion therapy, comprising:

a base, a table portion;

a tilting actuator coupling said base to said table portion and being configured to tilt said table portion between a horizontal position and a vertical position;

at least one foot mechanism mounted to said table portion via a mounting portion, each foot mechanism of the at least one foot mechanism configured to receive one foot of a patient, each said foot mechanism of the at least one foot mechanism comprising a foot mechanism base portion slidably coupled to said mounting portion and a footrest coupled to said foot mechanism base portion, each foot mechanism base portion being linearly slidable with respect to said mounting portion in a first direction along said table portion and in a second direction along said table portion independently of other foot mechanism base portions; and a leg movement mechanism configured to move the legs of the patient, wherein said leg movement mechanism comprises a first drive support for a left leg of the patient and a second drive support for a right leg of the patient.

2. The apparatus of claim 1, wherein said tilting mechanism is configured to tilt said table portion about an axis coupling the table portion with said tilting mechanism.

3. The apparatus of claim 2, wherein said first and second directions are substantially parallel to said table portion and perpendicular to said axis.

4. The apparatus of claim 1, further comprising an actuator configured to lift said table portion in a vertical direction.

5. The apparatus of claim 1, wherein said table portion is configured to accommodate the back of the patient.

6. The apparatus of claim 1, wherein said table portion includes a linear drive mechanism.

7. The apparatus of claim 1, wherein said table portion is tiltable to selectively adjust a hip extension or a hip flexion.

8. The apparatus of claim 1, wherein said footrest comprises a mechanical foot stimulation mechanism, wherein said apparatus further comprises a control unit to synchronously control said leg movement mechanism and said foot stimulation mechanism.

9. The apparatus of claim 1, wherein said footrest is coupled with said foot mechanism base portion via a double joint.

10. The apparatus of claim 9, wherein said double joint comprises a first joint coupled with said foot mechanism base portion, a second joint coupled with said footrest at a tip portion thereof, and an elongate member between said first joint and said second joint.

11. The apparatus of claim 1, wherein said foot mechanism comprises a load sensing mechanism.

12. The apparatus of claim 1, wherein a distance between said first drive support and said second drive support is adjustable.

13. The apparatus of claim 1, further comprising a pelvic harness for receiving a pelvic region of the patient.

14. The apparatus of claim 13, wherein said pelvic harness is coupled to said table portion.

15. The apparatus of claim 1, wherein said table portion is adapted to bear different portions of a load based on a tilting position of the apparatus.

16. The apparatus of claim 15, wherein said table portion is adapted to bear different portions of a load based on a tilting position of the apparatus, and in a substantially vertical position of said table portion a portion of the load is borne by a pelvic harness directly fixed to the apparatus and the portion of the load borne by the pelvic harness changes as a function of the tilting position of the apparatus.

17. The apparatus of claim 1, wherein the mounting portion of the at least one foot mechanism is fixedly mounted to the table portion.

18. The apparatus of claim 1, wherein when each said foot mechanism base portion of the at least one foot mechanism is moved in said first direction, each said foot mechanism base portion of the at least one foot mechanism linearly slides along said table portion towards said leg movement mechanism, and when each said foot mechanism base portion of the at least one foot mechanism is moved in said second direction, each said foot mechanism base portion of the at least one foot mechanism linearly slides along said table portion away from said leg movement mechanism.

19. An apparatus for locomotion therapy, comprising:

a base, a table portion;

a tilting actuator coupling said base to said table portion and being configured to tilt said table portion between a horizontal position and a vertical position;

at least one foot mechanism mounted to said table portion via a mounting portion, each foot mechanism of the at least one foot mechanism configured to receive one foot of a patient, each said foot mechanism of the at least one foot mechanism comprising a foot mechanism base portion slidably coupled to said mounting portion and a footrest coupled to said foot mechanism base portion, each foot mechanism base portion being linearly slidable with respect to said mounting portion in a first direction along said table portion and in a second direction along said table portion independently of other foot mechanism base portions; and a leg movement mechanism configured to move the legs of the patient, wherein said leg movement mechanism comprises a first drive support for a left leg of the patient and a second drive support for a right leg of the patient, wherein a distance between said first drive support and said second drive support is adjustable.

20. The apparatus of claim 19, wherein said distance between said first drive support and said second drive support being adjustable in a lateral direction substantially perpendicular to an adjustment direction of the table portion.

21. The apparatus of claim 19, wherein said table portion is adapted to bear different portions of a load based on a tilting position of the apparatus.

22. The apparatus of claim 21, wherein said table portion is adapted to bear different portions of a load based on a tilting position of the apparatus, and in a substantially horizontal position of said table portion substantially a full load of a torso of the patient is borne by said table portion.

23. An apparatus for locomotion therapy, comprising a standing table adjustable in inclination, a fastening belt with holding devices on the standing table for a patient, a drive mechanism to drive leg movement of the patient during locomotion therapy, comprising a knee mechanism and a foot mechanism, wherein said knee mechanism comprises a first drive support for a left leg of the patient and a second drive support for a right leg of the patient, wherein said foot mechanism comprises:

a mounting portion to be mounted to the standing table portion;

a foot mechanism having first and second base portions each slidably mounted on the mounting portion and configured to linearly slide with respect to said mounting portion in a first direction along the standing table and in a second direction along the standing table, the first and second base portions configured to linearly slide with respect to said mounting portion independently of each other during locomotion therapy; and a respective footrest coupled with a respective one of the first and second base portions via a joint at a tip portion of said respective footrest, each respective footrest configured to rotate via the joint relative to the respective one of the first and second base portions during locomotion therapy.

* * * * *